US009010569B1

(12) United States Patent
Estrada et al.

(10) Patent No.: US 9,010,569 B1
(45) Date of Patent: Apr. 21, 2015

(54) BOTTLE-WARMING CONTAINER DEVICE

(71) Applicants: Rosa M. Estrada, Fontana, CA (US); Claudia Thomas-Valdivia, Fontana, CA (US)

(72) Inventors: Rosa M. Estrada, Fontana, CA (US); Claudia Thomas-Valdivia, Fontana, CA (US)

( * ) Notice: Subject to any disclaimer, the term of this patent is extended or adjusted under 35 U.S.C. 154(b) by 0 days.

(21) Appl. No.: 13/949,723

(22) Filed: Jul. 24, 2013

(51) Int. Cl.
*B65D 25/18* (2006.01)
*A61J 9/06* (2006.01)
*B65D 81/38* (2006.01)

(52) U.S. Cl.
CPC .. *A61J 9/06* (2013.01); *B65D 81/38* (2013.01)

(58) Field of Classification Search
USPC ..... 220/592.25, 592.1, 592.03, 592.09, 220/592.12, 592.15, 592.22–592.24, 592.2, 220/739, 903; 62/457.5, 457.7, 457.4; 224/148.3; 206/545, 523–524, 589, 206/433; 215/395–397
See application file for complete search history.

(56) References Cited

U.S. PATENT DOCUMENTS

| | | | | | |
|---|---|---|---|---|---|
| 2,494,632 | A | * | 1/1950 | Rodin | 248/102 |
| 2,961,124 | A | * | 11/1960 | Hunter et al. | 206/163 |
| 3,401,535 | A | * | 9/1968 | Palmer | 62/457.5 |
| 3,848,766 | A | * | 11/1974 | Gantt et al. | 206/139 |
| 4,119,248 | A | * | 10/1978 | Butler et al. | 224/148.3 |
| 4,228,908 | A | | 10/1980 | Tweeton | |
| 4,295,345 | A | | 10/1981 | Atkinson | |
| 4,499,999 | A | * | 2/1985 | Behar | 206/546 |
| 4,620,579 | A | * | 11/1986 | Lowe et al. | 206/316.2 |
| 4,640,418 | A | * | 2/1987 | Lowry | 206/499 |
| 4,796,758 | A | * | 1/1989 | Hauk | 206/545 |
| 4,889,302 | A | | 12/1989 | Tucker | |
| 5,165,583 | A | * | 11/1992 | Kouwenberg | 224/148.3 |
| 5,421,172 | A | * | 6/1995 | Jones | 62/457.5 |
| 5,758,513 | A | | 6/1998 | Smith | |
| 5,862,937 | A | * | 1/1999 | Carrizales et al. | 220/501 |
| 5,988,879 | A | * | 11/1999 | Bredderman et al. | 383/13 |
| 6,234,165 | B1 | | 5/2001 | Creighton et al. | |
| 6,427,475 | B1 | | 8/2002 | DeFelice et al. | |
| 6,446,461 | B1 | * | 9/2002 | Williams, Jr. | 62/457.5 |
| 6,990,831 | B2 | * | 1/2006 | Fiene | 62/457.5 |
| D575,059 | S | | 8/2008 | Cappiello et al. | |
| 2004/0025530 | A1 | * | 2/2004 | Perrins | 62/457.5 |
| 2011/0226784 | A1 | * | 9/2011 | Boerhave | 220/592.2 |

* cited by examiner

*Primary Examiner* — Anthony Stashick
*Assistant Examiner* — Robert Poon

(57) ABSTRACT

A bottle-warming container device maintains the warmth of baby bottles for an extended period of time to ensure that warmed bottles are available when needed. The device includes a container having a bottom side and a perimeter wall extending upwardly from the bottom side. The perimeter wall and the bottom side define an interior space of the container configured to hold a plurality of baby bottles. A pad is positioned in the interior space and comprises an insulating material wherein the pad is configured for preventing heat transfer between the interior space and the extrinsic environment relative to the interior space. A plurality of slots extends through the pad wherein the slots are configured to receive the baby bottles. A flexible portion of the pad is positioned around each slot wherein a size of the slots is selectively adjustable.

1 Claim, 4 Drawing Sheets

BOTTLE-WARMING CONTAINER DEVICE

BACKGROUND OF THE DISCLOSURE

Field of the Disclosure

The disclosure relates to container devices and more particularly pertains to a new container device for maintaining the warmth of baby bottles for an extended period of time to ensure that warmed bottles are available when needed.

SUMMARY OF THE DISCLOSURE

An embodiment of the disclosure meets the needs presented above by generally comprising a container having a bottom side and a perimeter wall extending upwardly from the bottom side. The perimeter wall and the bottom side define an interior space of the container configured to hold a plurality of baby bottles. A pad is positioned in the interior space and comprises an insulating material wherein the pad is configured for preventing heat transfer between the interior space and the extrinsic environment relative to the interior space. A plurality of slots extends through the pad wherein the slots are configured to receive the baby bottles. A flexible portion of the pad is positioned around each slot wherein a size of the slots is selectively adjustable.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
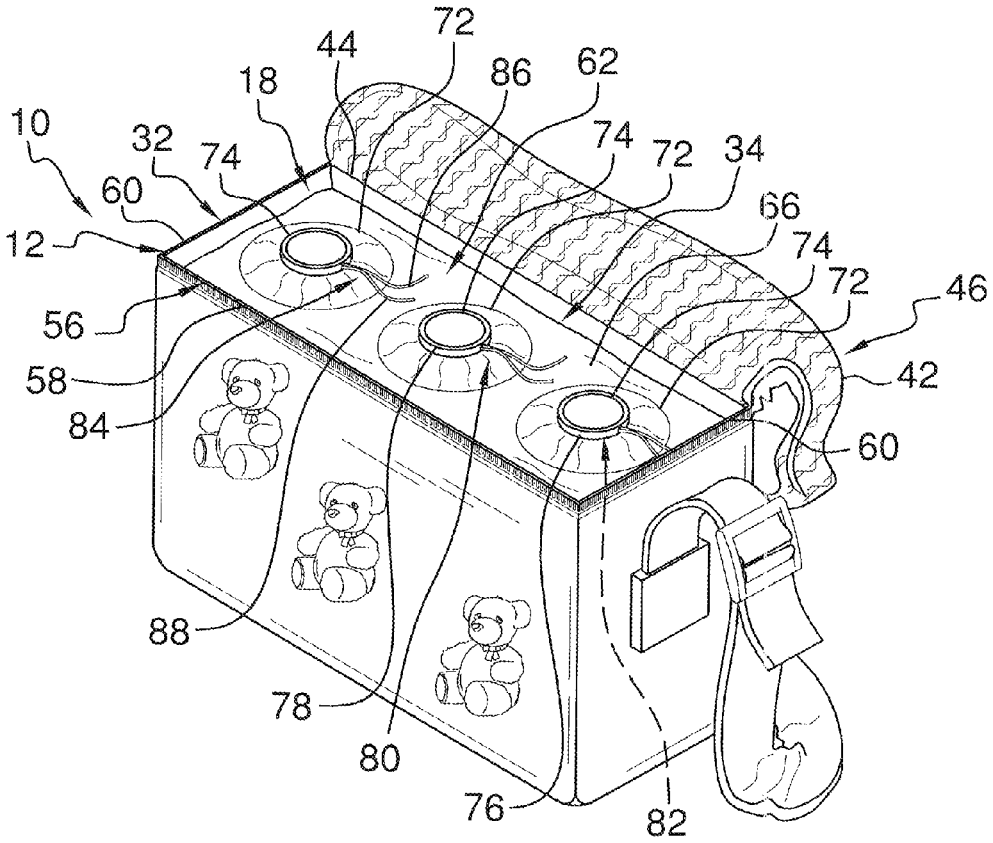
FIG. 1 is a top front side perspective view of a bottle-warming container device according to an embodiment of the disclosure shown in the opened position.
Figure 2:
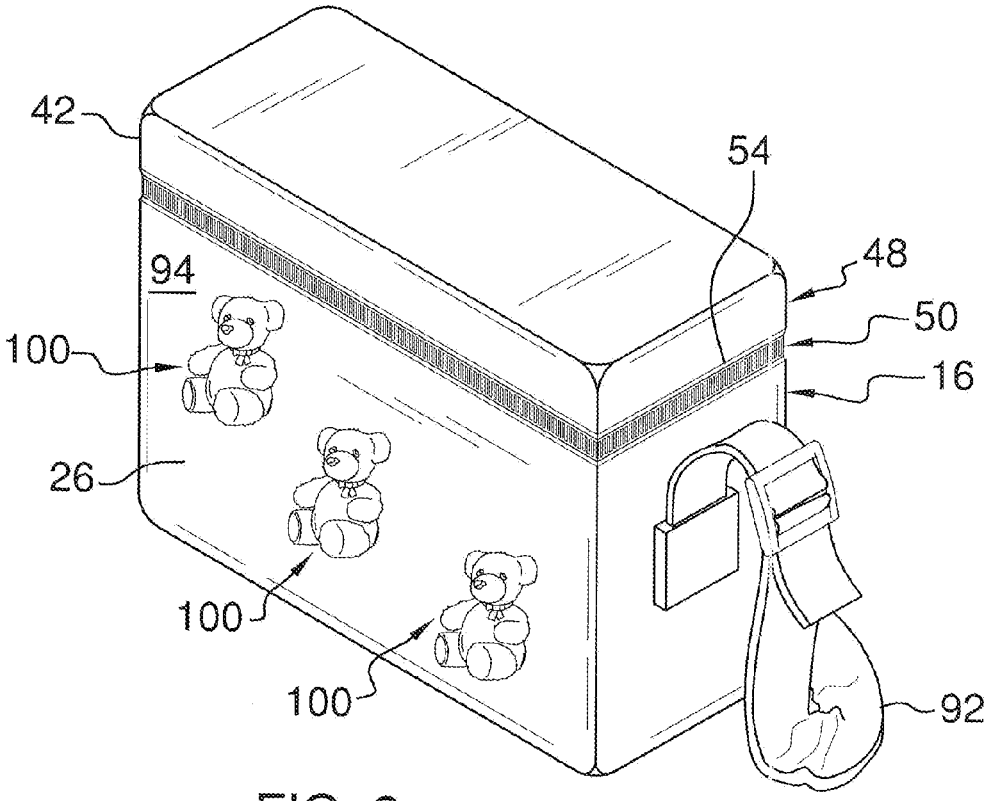
FIG. 2 is a top front side perspective view of an embodiment of the disclosure shown in the closed position.
Figure 3:
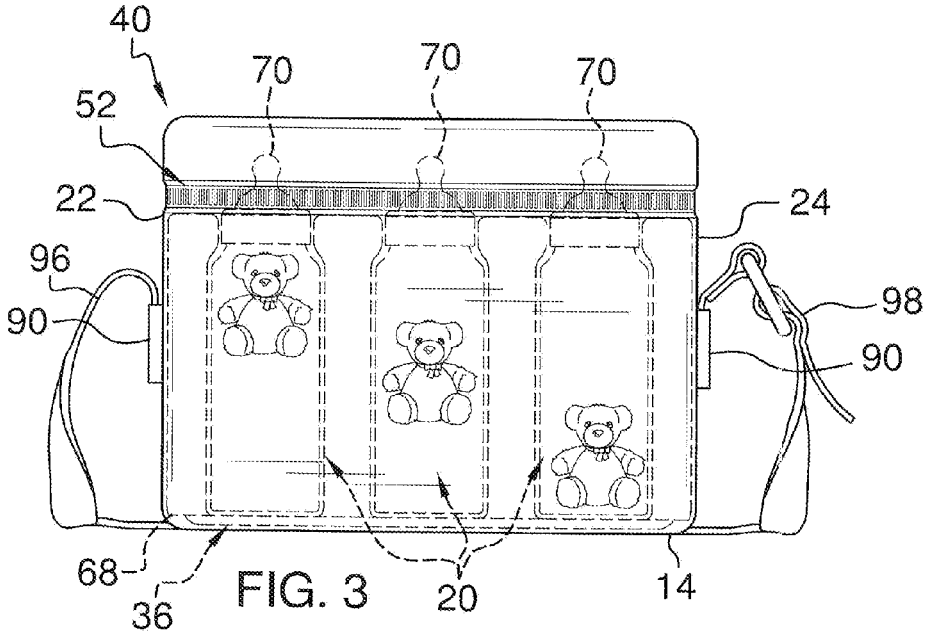
FIG. 3 is a front view of an embodiment of the disclosure.
Figure 4:
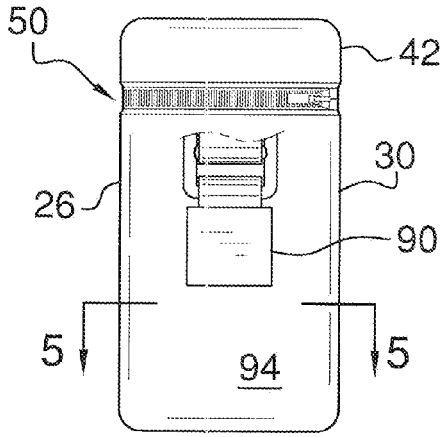
FIG. 4 is a side view of an embodiment of the disclosure.
Figure 5:
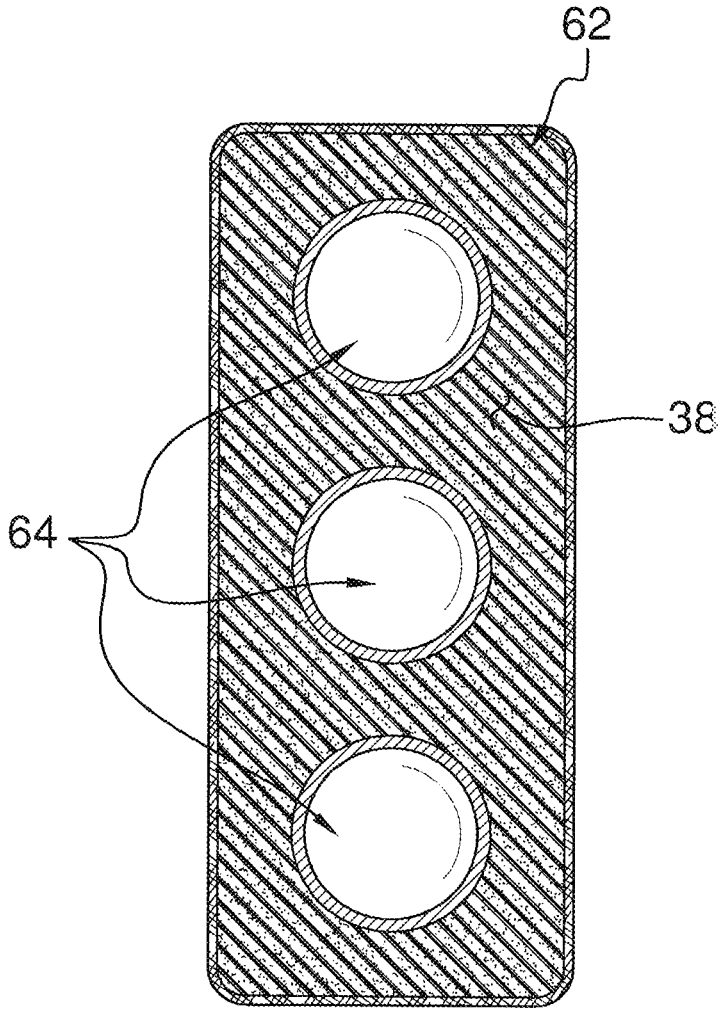
FIG. 5 is a cross-sectional view of an embodiment of the disclosure taken along line 5-5 of FIG. 4.

With reference now to the drawings, and in particular to FIGS. 1 through 5 thereof, a new container device embodying the principles and concepts of an embodiment of the disclosure and generally designated by the reference numeral 10 will be described.

As best illustrated in FIGS. 1 through 5, the bottle-warming container device 10 generally comprises a substantially rectangular container 12 having a bottom side 14 and a perimeter wall 16 extending upwardly from the bottom side 14. The perimeter wall 16 and the bottom side 14 define an interior space 18 of the container 12 configured to hold a plurality of baby bottles 20. Alternatively, perishable food items or other beverages may be placed within the interior space 18 of the container 12. The perimeter wall 16 includes a first side 22, a second side 24, a front side 26 and a back side 30. A perimeter edge 32 of the container 12 defines an opening 34 into the interior space 18. A panel 36 is preferably coupled to the container 12. The panel 36 is positioned in the interior space 18 and abuts the bottom side 14 of the container 12. The panel 36 is planar. The panel 36 is rigid and configured to maintain the container 12 in an upright position 40 and support the baby bottles 20 within the interior space 18. The panel 36 may be made of a hard plastic material or the like.

A lid 42 is pivotally coupled to a back end 44 of the perimeter edge 32. The lid 42 is selectively positionable between an opened position 46 exposing the opening 34 and a closed position 48 covering the opening 34. The lid 42 is preferably flexible. The lid 42 may comprise an insulating material wherein the lid 42 is configured for preventing heat transfer between the interior space 18 and an extrinsic environment relative to the interior space 18 when the lid 42 is in the closed position 48. The container 12 and the lid 42 have a combined height between approximately 10.0 centimeters and 20.0 centimeters and a combined length between approximately 20.0 centimeters and 30.0 centimeters.

A slidable fastener 50 may be used to couple the lid 42 to the container 12. The slidable fastener 50 comprises a first set of teeth 52 coupled to a bottom edge 54 of the lid 42 and a second set of teeth 56 coupled to a front end 58 and a pair of lateral ends 60 of the perimeter edge 32. The first 52 and second sets 56 of teeth releasably engage each other such that the first 52 and the second 56 sets of teeth are selectively interlocked to close the opening 34 of the container 12.

A pad 62 is positioned in the interior space 18. The pad 62 also comprises an insulating material 38 wherein the pad 62 is configured for preventing heat transfer between the interior space 18 and the extrinsic environment relative to the interior space 18. The pad 62 extends from the panel 36 upwardly toward the perimeter edge 32 of the container 12. A plurality of slots 64 extends through the pad 62. The slots 64 preferably extend from a top end 66 to a bottom end 68 of the pad 62 wherein each of the slots 64 is configured to receive one of the baby bottles 20 such that a teat 70 of the bottle 20 extends upwardly out of the slot 64 when the bottle 20 is positioned within the slot 64. The slots 64 are preferably spaced and horizontally aligned. The container 12 may include between three and six of the slots 64. A flexible annular portion 72 of the pad 62 is preferably positioned around each slot 64. The annular portion 72 is stretchable wherein a size of the slots 64 is selectively adjustable. A ring 74 extends around an inner edge 76 of each annular portion 72. The ring 74 comprises a perimeter wall 78 having an aperture 80 positioned therein wherein the aperture 80 provides access to an interior 82 of the ring 74. A drawstring 84 may extend through each of the rings 74. Each of the drawstrings 84 has a first free end 86 and a second free end 88 extending outwardly from an associated one of the apertures 80. The first 86 and second 88 free ends of the drawstrings 84 are graspable to cinch the bottles 20 positioned within the slots 64.

A pair of couplers 90 may be provided. Each of the couplers 90 is attached to an associated one of the first side 22 and the second side 24 of the perimeter wall 16. A strap 92 is preferably coupled to an exterior 94 of the container 12 wherein the strap 92 permits carrying of the container 12. A first end 96 of the strap 92 is mounted to the coupler 90 on the first side 22 of the container 12 and a second end 98 of the strap 92 is mounted to the coupler 90 on the second side 24 of the container 12. The strap 92 is preferably adjustable.

Indicia 100 may be positioned on the exterior 94 of the container 12 and is preferably positioned on the front side 26 of the perimeter wall 16. The indicia 100 may be diagonally aligned such that one of the indicia 100 is positioned proximate the perimeter edge 32, one of the indicia 100 is positioned proximate the bottom side 14, and one of the indicia 100 is centrally positioned between the perimeter edge 32 and the bottom side 14. The indicia 100 may resemble a plurality of teddy bears or the like.

In use, as stated above and shown in the Figures, up to six bottles 20 are filled with warm water and placed into the slots 64. The drawstrings 84 are then used to secure the bottles 20 within the slots 64. The slidable fastener 50 secures the lid 42 to the container 12, and the warmth of the bottles 20 is maintained for a period of up to approximately eight hours. In this manner, the bottles 20 are warm and ready when needed for feeding an infant. The strap 92 allows easy portability of the container 12 when desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A bottle-warming container device comprising:

a substantially rectangular container having a bottom side and a perimeter wall extending upwardly from said bottom side, said perimeter wall and said bottom side defining an interior space of said container configured to hold a plurality of baby bottles, said perimeter wall including a first side, a second side, a front side and a back side;

a perimeter edge of said container defining an opening into said interior space;

a panel coupled to said container, said panel being positioned in said interior space and abutting said bottom side of said container, said panel being planar and rigid wherein said panel is configured to maintain said container in an upright position and support the baby bottles within said interior space;

a lid pivotally coupled to a back end of said perimeter edge, said lid being selectively positionable between an opened position exposing said opening and a closed position covering said opening, said lid being flexible, said lid comprising an insulating material wherein said lid is configured for preventing heat transfer between said interior space and an extrinsic environment relative to said interior space when said lid is in the closed position;

a slidable fastener coupling said lid to said container, said slidable fastener comprising a first set of teeth coupled to a bottom edge of said lid and a second set of teeth coupled to a front end and a pair of lateral ends of said perimeter edge, said first and second sets of teeth releasably engaging each other such that said first and said second sets of teeth are selectively interlocked to close said opening of said container;

a pad positioned in said interior space, said pad comprising an insulating material wherein said pad is configured for preventing heat transfer between said interior space and the extrinsic environment relative to said interior space, said pad extending from said panel upwardly toward said perimeter edge of said container;

a plurality of slots extending through said pad, said slots extending from a top end to a bottom end of said pad wherein each of said slots is configured to receive one of the baby bottles such that a teat of the bottle extends upwardly out of said slot when the bottle is positioned within said slot, said slots being spaced and horizontally aligned, said container including between three and six of said slots;

a flexible portion of said pad being positioned around each said slot wherein a size of each said slot is selectively adjustable, said flexible portion being annular;

a ring extending around an inner edge of each said flexible portion, said ring comprising a perimeter wall having an aperture positioned therein wherein said aperture provides access to an interior of said ring;

a drawstring extending through each of said rings, each of said drawstrings having a first free end and a second free end extending outwardly from an associated one of said apertures, said first and second free ends of said drawstrings being graspable to cinch the bottles positioned within said slots;

a pair of couplers, each of said couplers being attached to an associated one of said first side and said second side of said perimeter wall;

a strap coupled to an exterior of said container wherein said strap permits carrying of said container, a first end of said strap being mounted to said coupler on said first side of said container and a second end of said strap being mounted to said coupler on said second side of said container, said strap being adjustable; and indicia positioned on said exterior of said container, said indicia being positioned on said front side of said perimeter wall, said indicia being diagonally aligned such that one of said indicia is positioned proximate said perimeter edge, one of said indicia is positioned proximate said bottom side, and one of said indicia is centrally positioned between said perimeter edge and said bottom side, said indicia resembling a plurality of teddy bears.

* * * * *